US012704361B2

(12) United States Patent
Vainshtein et al.

(10) Patent No.: US 12,704,361 B2
(45) Date of Patent: Aug. 11, 2026

(54) FIN CONTROL ACTUATION SYSTEM

(71) Applicant: RAFAEL ADVANCED DEFENSE SYSTEMS LTD., Haifa (IL)

(72) Inventors: Alexander Vainshtein, Haifa (IL); Michael Shneider, Haifa (IL)

(73) Assignee: RAFAEL ADVANCED DEFENSE SYSTEMS LTD., Haifa (IL)

( * ) Notice: Subject to any disclaimer, the term of this patent is extended or adjusted under 35 U.S.C. 154(b) by 373 days.

(21) Appl. No.: 18/246,835

(22) PCT Filed: Sep. 29, 2021

(86) PCT No.: PCT/IL2021/051169
§ 371 (c)(1),
(2) Date: Mar. 27, 2023

(87) PCT Pub. No.: WO2022/070183
PCT Pub. Date: Apr. 7, 2022

(65) Prior Publication Data

US 2023/0375317 A1 Nov. 23, 2023

(30) Foreign Application Priority Data

Oct. 1, 2020 (IL) ..... 277997

(51) Int. Cl.
*F42B 10/64* (2006.01)
*F42B 10/66* (2006.01)

(52) U.S. Cl.
CPC ..... *F42B 10/64* (2013.01); *F42B 10/665* (2013.01)

(58) Field of Classification Search
CPC ..... F42B 10/64; F42B 10/665; F42B 10/62
See application file for complete search history.

(56) References Cited

U.S. PATENT DOCUMENTS 4,272,040 A * 6/1981 Bastian ..... F02K 9/90 239/265.19
5,259,569 A * 11/1993 Waymeyer ..... G05D 1/107 244/3.21

(Continued)

FOREIGN PATENT DOCUMENTS

CA 2176048 C * 2/2000 ..... F02K 9/805

OTHER PUBLICATIONS

Liu and Tsay (2002) Contact characteristics of beveloid gears. Mechanism and Machine Theory 37: 333-350.

(Continued)

*Primary Examiner* — Assres H Woldemaryam
(74) *Attorney, Agent, or Firm* — Fuller IP LAW LLC; Rodney J. Fuller

(57) ABSTRACT

A mechanism for steering and maneuvering an airborne body comprised of at least one actuator comprising an electric motor having a first axis, and a gear transmission for transmitting power from the electric motor to an angular motion axis of a fin that has an angular motion around a second axis to steer the airborne body, and wherein the mechanism is characterized in that the gear transmission is a beveloid gear type of transmission, an airborne body that comprised the mechanism, and a method for achieving the desired flight path of an airborne body implementing the mechanism.

19 Claims, 10 Drawing Sheets

(56) References Cited

U.S. PATENT DOCUMENTS

| | | | | |
|---|---|---|---|---|
| 5,505,408 | A * | 4/1996 | Speicher | F42B 10/663 244/3.22 |
| 5,662,290 | A * | 9/1997 | Voigt | F42B 10/666 244/3.21 |
| 5,950,963 | A * | 9/1999 | Speicher | F42B 10/64 244/3.21 |
| 5,975,461 | A | 11/1999 | Ullrich | |
| 6,978,967 | B1 * | 12/2005 | Scheper | F42B 10/16 102/385 |
| 7,923,671 | B1 * | 4/2011 | Huguenin | F42B 10/64 244/3.24 |
| 11,733,011 | B2 * | 8/2023 | Bugge | F02K 9/805 244/3.22 |
| 2006/0150765 | A1 * | 7/2006 | Turner | F42B 10/64 74/665 F |
| 2006/0289695 | A1 | 12/2006 | Bois | |
| 2008/0029641 | A1 * | 2/2008 | Carlson | F42B 10/64 244/3.24 |
| 2009/0218437 | A1 * | 9/2009 | Sirimarco | F42B 10/64 114/144 R |
| 2011/0177904 | A1 * | 7/2011 | Kirschner | B63H 5/125 475/149 |
| 2013/0032659 | A1 | 2/2013 | Castor | |

OTHER PUBLICATIONS

Zeyin et al., (2014) Mathematical models and dynamic contact analysis of involute/noninvolute beveloid gears. Journal of Vibroengineering 16(6): 2949-2961.

Zheng et al., (2016) Analysis on Tooth Profile Comparison and Contact Characteristics of Beveloid Gear. In 2016 6th International Conference on Machinery, Materials, Environment, Biotechnology and Computer (MMEBC 2016). Atlantis Press, pp. 1763-1770.

* cited by examiner

FIN CONTROL ACTUATION SYSTEM

CROSS-REFERENCE TO RELATED APPLICATIONS

This application is the U.S. National Stage of International Patent Application No. PCT/IL2021/051169, filed on Sep. 29, 2021, which claims the benefit of and priority to Israel Patent Application No. 277997, filed on Oct. 1, 2020, the contents of each of which are hereby incorporated by reference in their entireties.

FIELD OF THE INVENTION

The invention of the Patent Application is in the field of mechanisms used for steering and maneuvering airborne bodies, such as missiles, toward their targets, and particularly in the field of mechanisms based on fins (rudders) that protrude from the airborne body and move in the desired direction and degree in order to achieve the airborne body's desired course of flight by aerodynamic maneuvering, also known as FAS (Fin Actuation Systems), as well as fin-based mechanical systems located in the rocket motor nozzle, and are used to steer missiles by diversion of exhaust gas (jet vanes), also known as TVC (Thrust Vector Control).

BACKGROUND OF THE INVENTION

There are known and familiar airborne bodies, such as missiles, which are steered to their target by an FAS system, which includes an assembly for actuating fins that protrude from the airborne body and controlling their angular position relative to the airborne body according to flight commands, known as FCAS (Fin Control Actuation System). Similarly, there are known and familiar missiles that are steered to their target using a TVC system (alone or in combination with FAS system).

The background of the invention of the Patent Application and an Exemplifying Embodiment of the invention itself will be described below in relating to a missile-type airborne body having a rocket propulsion system, and FCAS assembly which is used to steer a circumferential array of four protruding tail wings. However, a person skilled in the art would understand that the invention is also applicable to steering other airborne bodies (e.g. jet-powered cruise missiles, guided bombs, guided artillery shells, etc.), for steering a different plurality of fins (not necessarily four), and for steering other or additional types of fins (e.g. for steering a canard array of fins that are positioned while protruding from the front part of the airborne body or for steering an array of fins positioned in the middle of the airborne body). A person skilled in the art would also understand that the invention is also applicable to directing missiles, in its embodiment in a TVC system wherein the fins are implemented as jet vanes (using it alone or in combination with an FAS system).

In a rocket-propelled missile that is steered by tail control of four rear fins, the FCAS assembly includes four electromechanic actuators (corresponding with the four fins), and an electronic system that is connected to them, and they are all integrated, when packaged into an apparatus with a ring-like (toroidal) cross section. A ring-like apparatus, which when mounted in the missile, is positioned around the rear section of the missile motor and encompasses it and merges with the missile's exterior line of design (the missile fuselage outer cover or case skirt).

Therefore, persons skilled in the art face the challenge of having to package the FCAS assembly given space limitations, due to the desire to make the outer diameter of the missile as compact as possible, starting with the dimensions of the missile motor in the rear (e.g. dimensions and geometry of the rocket motor's pressure control throat and gas expansion nozzle), while also having to provide adequate solution to the need of propelling the missile fins at the required torque (the need to transmit as high mechanical power as required, so that the steering of the fins will be rapid to precisely provide the missile with sharp maneuverability) with minimum backlash, and wherein the angular motion axes of the fins (the steering axes) are positioned perpendicular to the missile's central longitudinal axis.

Reference is made to FIG. 1. FIG. 1 schematically depicts in perspective the aforementioned packaging challenge (in the context of merely an exemplifying illustration) of an FCAS assembly for rocket-propelled missile 10, wherein the assembly is used to steer a circumferential array of four tail wings (not illustrated). Volume 20, having a toroidal ring like cross-section, is a geometric design constraint owing to the outer diameter D of missile 10 (a diameter that is usually sought to be minimized, e.g. for aerodynamic reasons, weight reduction, etc.), the dimensions of the missile motor in the rear section and its varying geometry (e.g. in the illustrated example—the design of nozzle 23 of rocket motor 25), the L-length dimension that can be allocated along the missile (a longitudinal dimension that is usually sought to be minimized for aerodynamic reasons, volume reduction, weight reduction, etc.), and wherein the angular motion axes (steering axes) of the fins (not illustrated), (four in the illustrated example)—30, 35, 40, 45 are each positioned perpendicular to the central longitudinal axis 50 of the missile.

Therefore, in designing the FCAS assembly, persons skilled in the art are required to achieve high energy efficiency within the constraints of a relatively small packaging design, and which in the example in question also has a unique geometric form—a volume having a toroidal cross-section configuration with varying dimensions along its length (according to the design of the rocket motor's pressure control throat and gas expansion nozzle).

Prior to the invention which is the subject matter of the Patent Application, skilled persons addressed these challenges, for example, by positioning the electric motor axis of each of the fins parallel to the angular motion axis of that fin, and laying the gear transmission between them. Because of the volume constraints of the toroidal cross-section, such a configuration might require a longitudinal displacement of the array of motors relative to the plane of the angular motion axes of the fins. The array of motors is then positioned along the longitudinal axis of the missile, at a different plane than the plane of the angular motion axes of the fins and parallel to it, thereby requiring a gear transmissions to bridge the geometric distance between the different planes in addition to transmitting the power needed.

Reference is made to FIGS. 2 and 3. FIG. 2 schematically depicts in perspective the aforesaid prior art packaging solution for missile 10 of FCAS assembly 215. FIG. 3 is a partial section side view of the prior art FCAS assembly 215 (without the fins), the array of motors (four in the illustrated example)—250, 255, 260, 265 positioned along central longitudinal axis 50 of missile 10 in a circumferential configuration relative to central longitudinal axis 50, spanning over plane 270 that is perpendicular to central longitudinal axis 50. Plane 275 is also perpendicular to central longitudinal axis 50, on which the angular motion axes of fins 280, 285, 290, 295 extend while they are perpendicular in their directions to central longitudinal axis 50. Each of the motor axes is positioned parallel to the angular motion axis of the fin that it propels and spaced from it. Plane 270 is at a different plane than plane 275. Plane 270 is displaced from plane 275 and positioned parallel to it. The planes are spaced apart from each other at a dimension LPA, in a manner that, as mentioned, requires gear transmissions—282, 287, 292, 297 to bridge the LPA geometric distance between the different planes.

Therefore, according to the aforementioned prior art, the FCAS assembly is actually packaged at two different planes that are displaced along the longitudinal axis of the missile, wherein gear transmissions are needed to bridge between the planes in a way that eventually reduce the volumetric efficiency and make it difficult to achieve the volumetric minimization sought by persons skilled in the art.

Moreover, according to the illustrated example, the transmission constraints call for parallel positioning of each of the motor axes in relation to the angular motion axis of the fin it propels, which also limits the ability to achieve the required compact packaging.

Moreover, as previously noted, the FCAS assembly is required to operate with minimum backlash. The mechanical precision requirements from the assembly in its operation, i.e. precision of the angular tilt of each of the fins, calls for tightening the tolerances and reducing the lost motion phenomenon (which is caused by the spaces between parts of the mechanism). According to the above prior art, the existing solution is to increase the diameter of the cog-wheel at the exit from each of the gear transmissions, in a manner that also increases dimensions, which in turn reduces volumetric efficiency and makes it difficult to achieve the volumetric minimization to which persons skilled in the art aspire.

At the same time, in the transmission field, beveloid gear transmissions (also referred to as conical involute gears) are known to be used for transmitting rotational mechanical energy from one point to another and enable producing a crossing angle or skew axes between two intermingled gears. Beveloid gears have long been used for marine applications and in the automotive field (e.g. in four-wheel drive vehicles for transmitting torque and rotational motion from the gearbox to the front axis that may not be in a parallel position).

Beveloid gears have been analyzed and discussed in the following publications:

H. E. Merritt, "Gears", Pitman, London, 1955, pages 165-170;

A. S. Beam, "Beveloid Gearing", Machine Design, Vol. 26, December, 1954, pages 220-238;

S. C. Purkiss, "Conical Involute Gears: Part 1", Machinery 89, 1956, pages 1403-1420; and C. C. Liu, C. B. Tsay, "Contact characteristics of beveloid gears", Mech. Mach. Theory, No. 37, 2002, pages 333-350.

SUMMARY OF THE INVENTION

The invention solves the minimization and volumetric efficiency challenges faced by skilled persons, who are designers of mechanisms used for steering and maneuvering airborne bodies, and overcomes the shortfalls in the prior art previously discussed in the "Background of the Invention" chapter by implementing beveloid gears as a means for transmitting power from the electric motors in the assembly to the angular motion axes of the fins in the airborne body, in a manner that allows for compact packaging of all the system components (motors, transmission, axes of the fins) in a circumferential, toroidal ring like assembly, on a single plane, while enhancing propulsion performance of the airborne body's fins, at the required torque, precisely and with minimum backlash.

In one aspect, the invention is a mechanism used to steer and maneuver airborne bodies, whether in an FCAS assembly of an airborne body (e.g. in a rocket-propelled missile, jet-powered cruise missile, guided bomb or a guided artillery shell) or in a TVC assembly in a missile. A mechanism that comprises at least one actuator, which is comprised of an electric motor having a first axis and a gear transmission for transmitting power from the electric motor to an angular motion axis of a fin (e.g. tail wing) having an angular motion around a second axis to steer the airborne body by aerodynamic maneuvering manner or TVC, as aforesaid, and wherein the mechanism in accordance with the invention, is characterized in that the said gear transmission is a beveloid gear type of gear.

In another and additional aspect of the invention, the beveloid gear transmission transmits power from the electric motor to the fin, wherein the motor axis is not parallel to the fin axis, but is positioned in creating an angle between the two axes.

In one embodiment of the invention, the mechanism, which is used to steer and maneuver airborne bodies according to the invention, is embodied as an FCAS assembly of a missile having a rocket propulsion system along its central longitudinal axis, wherein the mechanism is comprised of a circumferential array of four actuators, and is characterized in that— a. The circumferential array of the four actuators is installed in the assembly in an apparatus having a toroidal ring-like cross-section, which is adapted for installation around the rear section of the missile motor while encompasses it and merges with the missile's exterior line of design, and
b. Wherein the circumferential array of four actuators is packaged in one plane perpendicular to the central longitudinal axis of the missile, and
c. The assembly is adapted for installation of four fins on top of it, each of which has an angular motion revolving around an axis by means of the circumferential array of four actuators, and
d. In each of the actuators, the motor motion axis is not parallel to the fin axis, but is positioned in creating an angle between the two axes, and
e. Once the assembly is installed in the missile, the four fins serve as tail wings of the missile for steering it by tail control of the four fins.

In another and additional aspect of the invention, the invention is embodied in the airborne body that comprised a mechanism, which is used for steering and maneuvering airborne bodies according to the invention, whether in an FCAS assembly of any airborne body (e.g. in a rocket-propelled missile, jet-powered cruise missile, guided bomb or a guided artillery shell), or in a TVC assembly in a missile. In other words, the invention is embodied in the airborne body in which the mechanism is installed, which is characterized in that the gear transmission used to transmit power from an electric motor to an angular motion axis of a fin having an angular motion that revolves around an axis, is gear transmission of beveloid gear type.

In another and additional aspect, the invention embodies a general method in the field of mechanisms, which are implemented to steer and maneuver airborne bodies, whether in an FCAS assembly of any airborne body (e.g. in a rocket-propelled missile, jet-powered cruise missile, guided bomb or a guided artillery shell) or in a TVC assembly in a missile. That is to say, a general method in the field of mechanical systems that are based on fins that move in the desired direction and to the desired extent in order to achieve the desired flight path of an airborne body. A method that comprise the steps of— a. Packaging the airborne body with an assembly comprised of gear transmissions of the beveloid gears type as a means for transmitting power from the electric motors in the assembly to the angular motion axes of the fins of the airborne body; and
b. Steering the airborne body by transmitting power, as needed, from the electric motors in the above assembly to the angular motion axes of the fins of the airborne body through the transmissions in order to change their position in an angular motion, thereby obtaining the desired flight path of the airborne body.

Other aspects of the invention will become apparent by consideration of the detailed description and accompanying drawings

BRIEF DESCRIPTION OF THE ATTACHED FIGURES

Different aspects of at least one embodiment of the invention that is the subject of the Patent Application will be described below, with reference to the accompanying figures (while no scale should be attributed to them). The figures are presented for illustrative purposes only and for facilitating an understanding of the different aspects of the invention and the possible configurations for its actual embodiment. The figures are part of the description, but should not be construed as limiting the invention in any way. In the figures, an identical or similar element that is visually depicted in several figures could be tagged by uniform numbering. For clarity, not every element was tagged in each of the figures. In the following figures:

FIG. 1 schematically depicts in perspective the packaging challenge facing a person skilled in the art in the context of merely an exemplifying illustration of an FCAS assembly of a missile having a rocket propulsion system, wherein the assembly serves for steering a circumferential array of four tail wings.

FIGS. 2 and 3 schematically depict (respectively) in a perspective view and partial cross-section side view, the prior art solution for the packaging challenge described above in reference to FIG. 1.

FIGS. 4 and 5 schematically depict (respectively), in a perspective view and zoom-in perspective view, an example of an FCAS assembly according to the invention, as it is installed, according to the illustrated example, in a missile having a rocket propulsion system, wherein the assembly according to the invention is used for steering a circumferential array of four tail wings (similar to the missile illustrated in FIGS. 1-3).

FIGS. 6 and 7 schematically depict (respectively) a front view and side view (in a partial cross-section) of the FCAS assembly according to the invention that is illustrated in FIGS. 4 and 5.

DETAILED DESCRIPTION OF A PREFERRED EMBODIMENT OF THE INVENTION

Various devices and elements will be described below strictly for the purpose of providing an example of an embodiment of the claimed invention. The embodiment described below does not limit the claimed invention, and the latter may also apply to different apparatuses and methods that those described below. The claimed invention does not have to include all aspects of the apparatuses, elements and methods described below, and is not strictly limited to those that exist in all the configurations described below. For the sake of integrity, it should be noted that the set of claims on the invention may be revised by way of amendment and/or by filing a divisional application. The skilled person will also understand that, for the sake of clarity, the configurations are described without delving into a lengthy description of elements, methods and processes that are already basic principles in the field and for which no tagged reference was provided in the figures.

Figure 1:
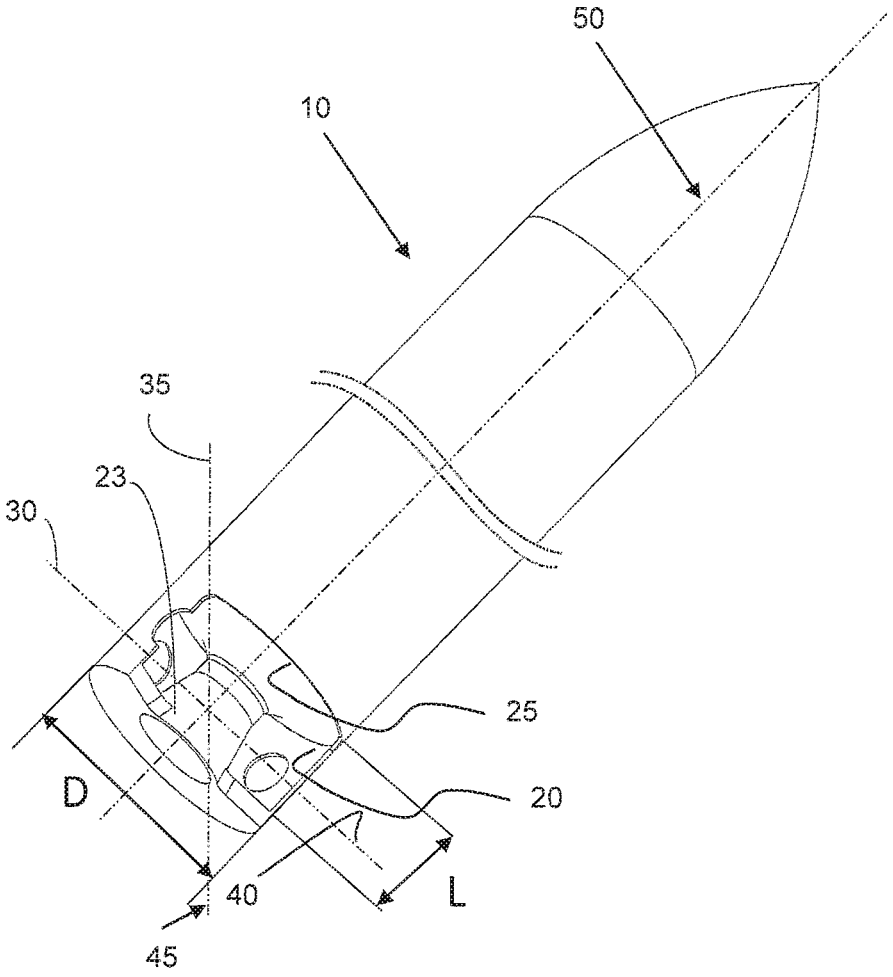
Figure 3:
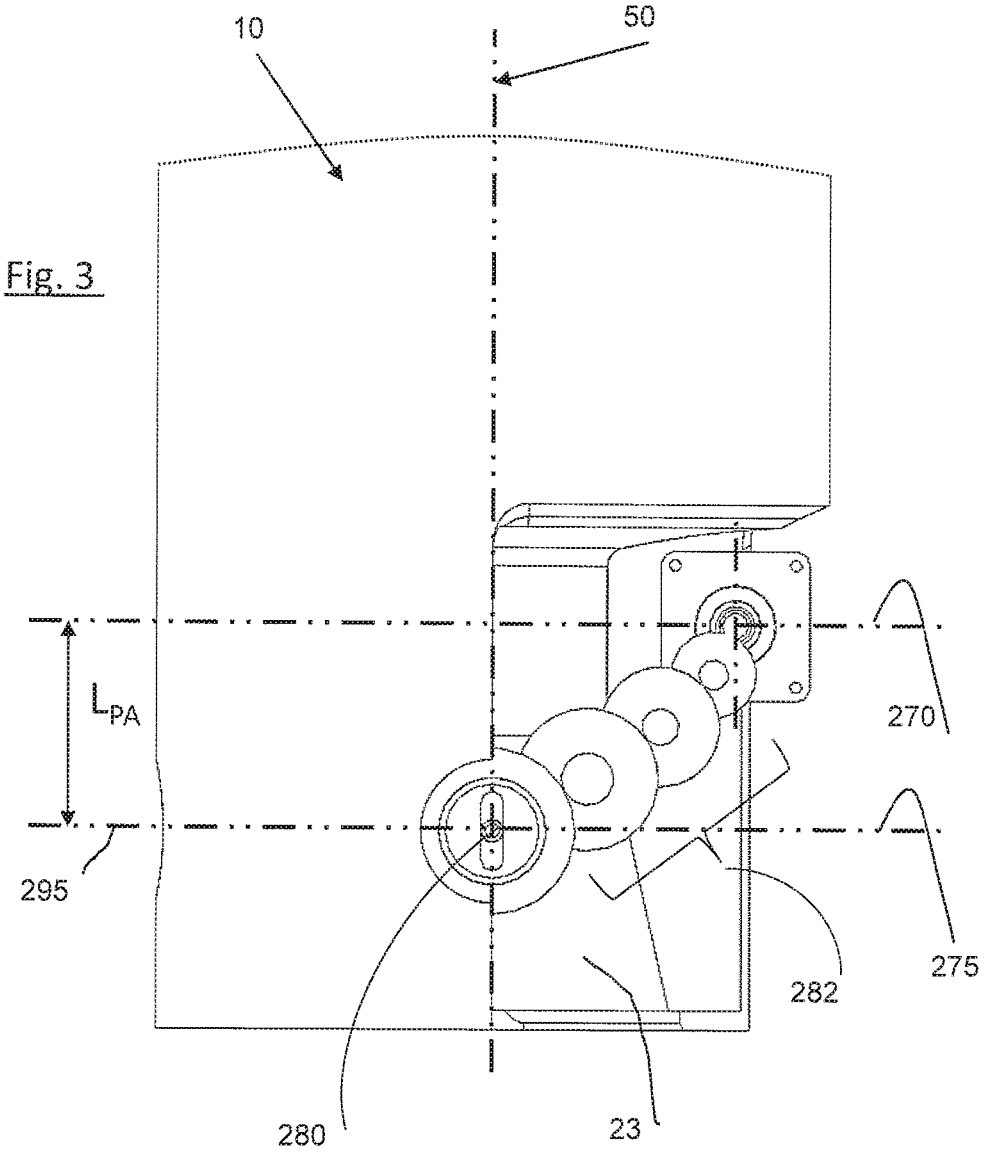
Figure 4:
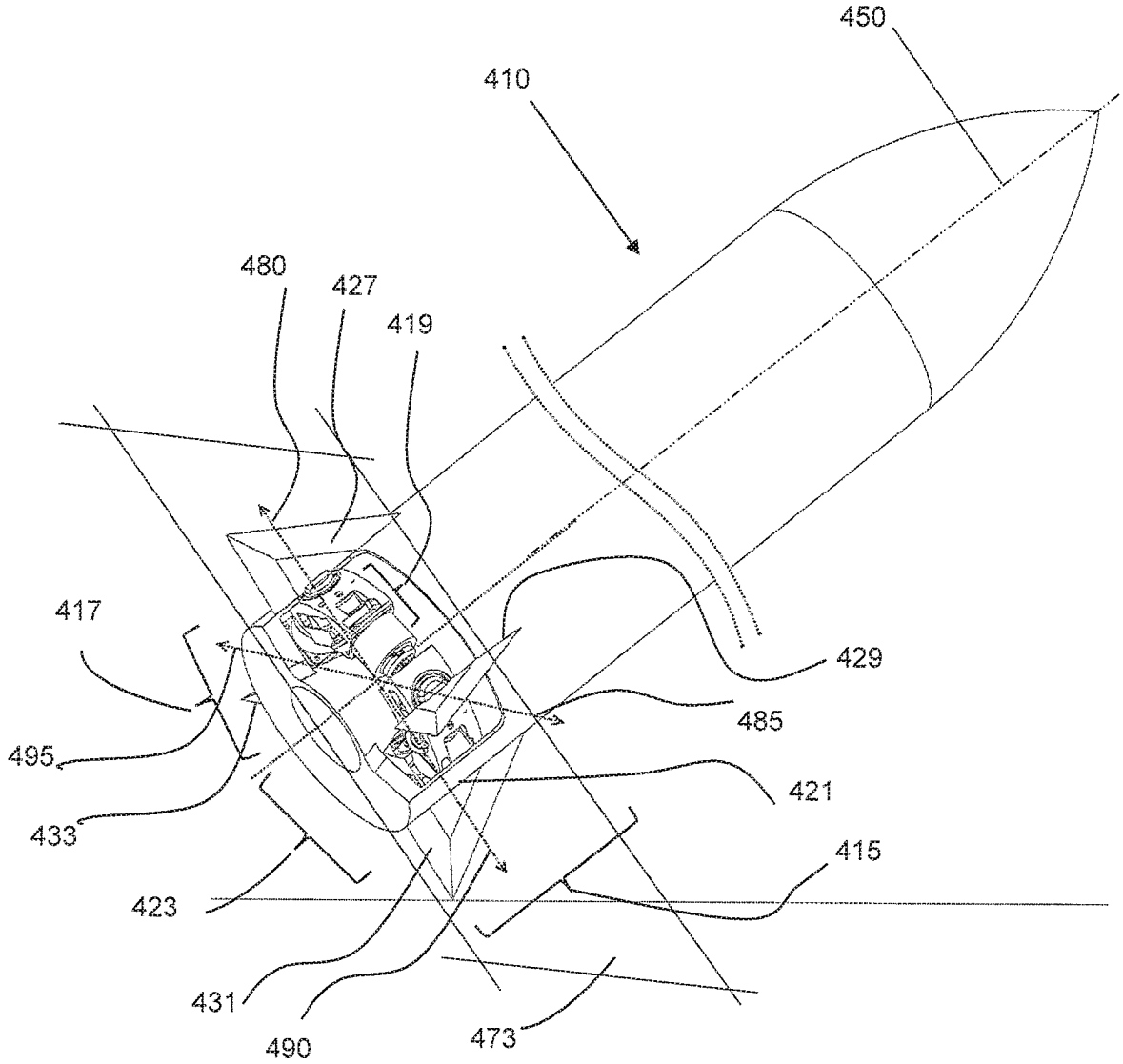
Figure 5:
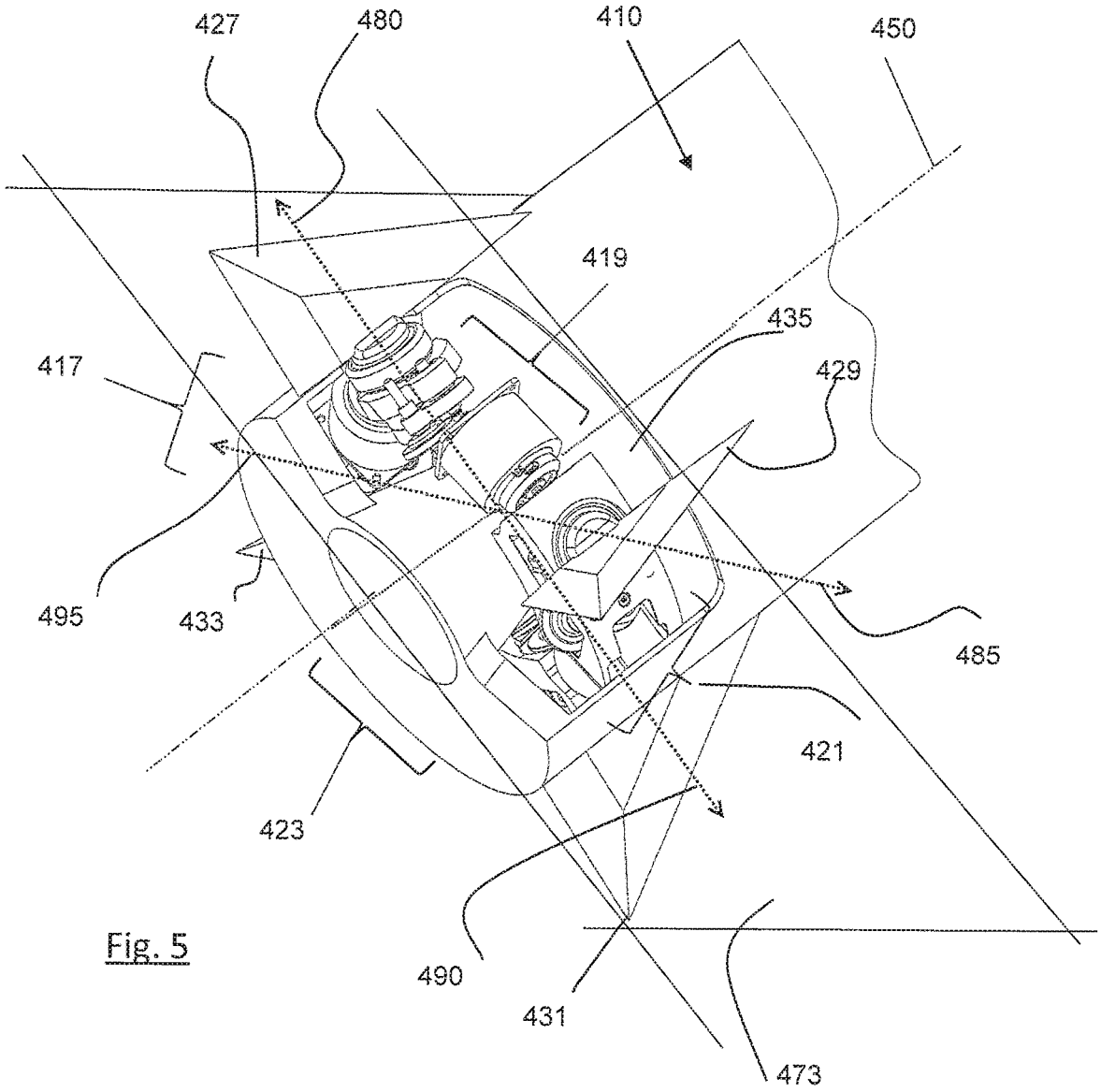

Reference is made to FIGS. 4 and 5. FIGS. 4 and 5 schematically depict (respectively), in a perspective view and zoom-in perspective view, an example of an FCAS assembly 415 according to the invention, as it is installed, according to the illustrated example, on missile 410 having a rocket propulsion system along its central longitudinal axis 450, wherein assembly 415 serves for steering a circumferential array of four tail wings (similar to missile 10 illustrated in FIGS. 1-3).

According to the illustrated example, FCAS assembly 415 is a mechanism for steering and maneuvering missile 410, which includes a circumferential array of four actuators—417, 419, 421, 423.

Assembly 415 is adapted for installation with four fins 427, 429, 431, 433.

Each of the fins has an angular motion around an axis. Fin 427 around axis 480, fin 429 around axis 485, fin 431 around axis 490, and fin 433 around axis 495.

The propelling of each of the fins for angular motion is provided by the circumferential array of the four actuators.

The circumferential array of the four actuators is packaged in one, single plane 473, which extends perpendicular to central longitudinal axis 450 of missile 410.

Any skilled person would understand that the circumferential array of the four actuators is installed in assembly 415 by means of bracket 435, having a toroidal ring-like cross-section configuration, which is adapted for installation around the rear section of missile motor 410 while encompasses it and merges with the missile's exterior line of design.

Figure 6:
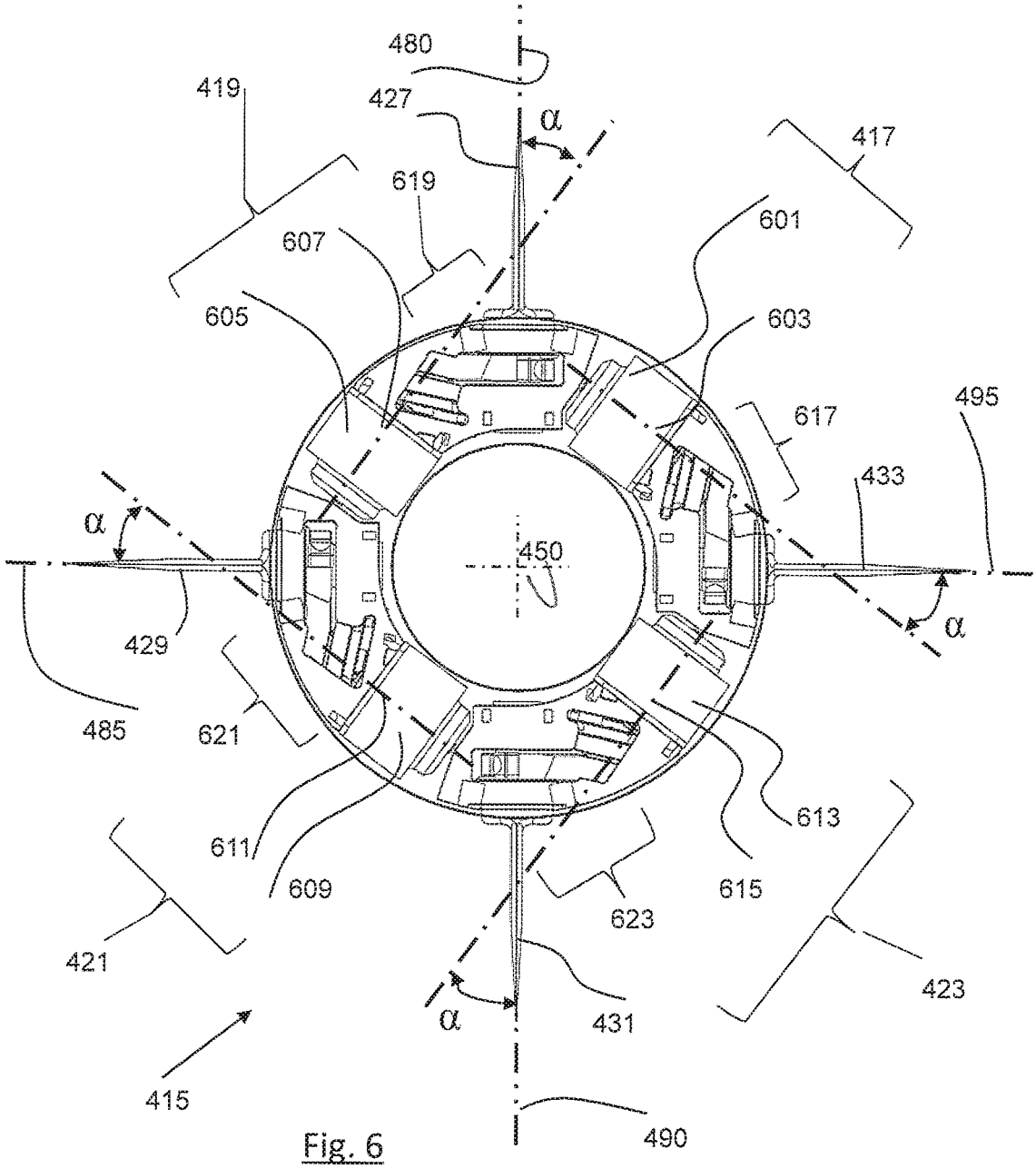
Figure 7:
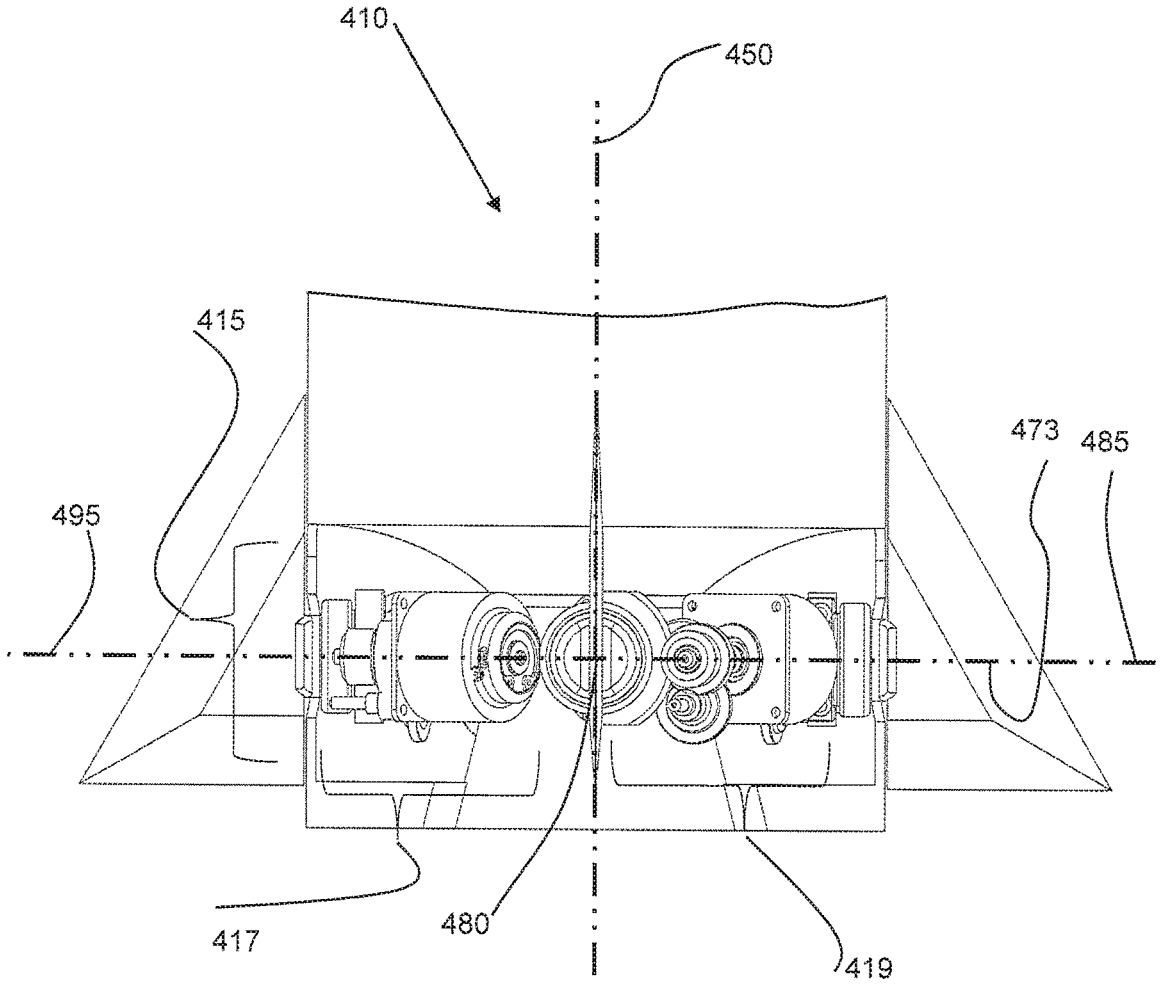

Reference is made to FIGS. 6 and 7. FIGS. 6 and 7 schematically depict (respectively) a front view (from the direction of the nose of missile 410) and a side view (in partial cross-section) of FCAS assembly 415.

Each of the four actuators comprise an electric motor having a propulsion axis (hereinafter—the first axis). In actuator 417—electric motor 601 having propulsion axis 603; in actuator 419—electric motor 605 having propulsion axis 607; in actuator 421—electric motor 609 having propulsion axis 611; and in actuator 423—electric motor 613 having propulsion axis 615.

Each of the actuators also comprise gear transmission for transmitting power from its electric motor to the angular motion axis of the fin with which it is connected (hereinafter—the second axis of motion). In actuator 417—gear transmission 617 transmits power from motor 601 to angular motion axis 495 of fin 433; in actuator 419 gear—gear transmission 619 transmits power from motor 605 to angular motion axis 480 of fin 427; in actuator 421—gear transmission 621 transmits power from motor 609 to angular motion axis 485 of fin 429; and in actuator 423—gear transmission 623 transmits power from motor 613 to angular motion axis 490 of fin 431.

In each actuator, the motor axis (the first axis) is located on the same plane with the fin axis (the second axis), wherein the motor axis (the first axis) is not parallel to the fin axis (the second axis), but located in forming an a angle between the two axes. In other words, unlike the prior art solution described in the "Background of the Invention" chapter with reference to FIGS. 2 and 3, in accordance with the depicted exemplifying embodiment of the invention, in the actuators of the invention, the first axis of the motor is not parallel to the second axis of the fin to which it is connected to propel, but rather is positioned on the same plane with it while creating an angle between the two axes.

FCAS assembly 415, as a mechanism, is characterized in that each of the gear transmissions is a beveloid gear type of gear.

Figure 8:
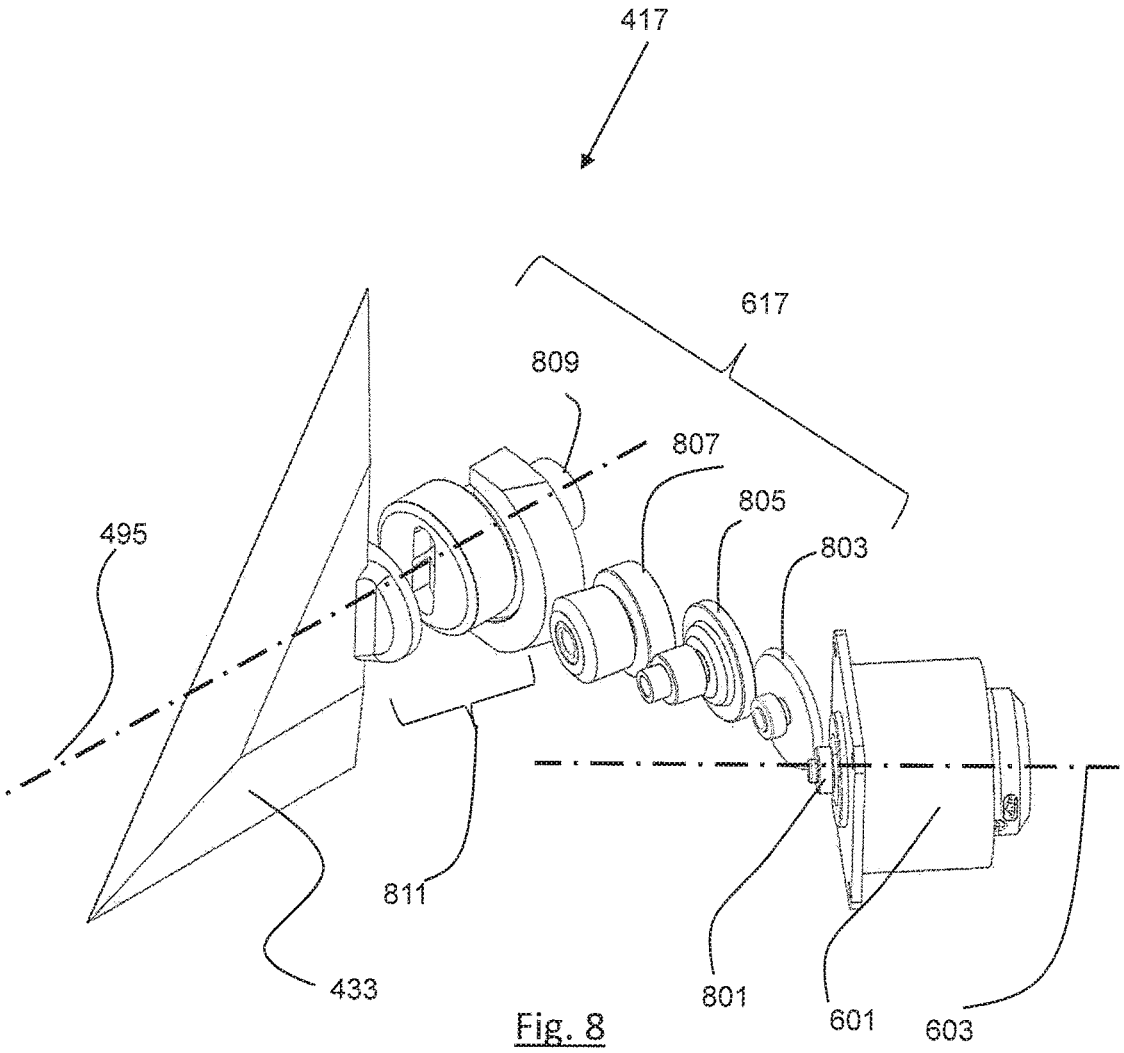
FIG. 8 depicts an "exploded" view of components of one actuator, four of which are installed in the FCAS assembly according to the invention, which is illustrated in FIGS. 4-7.

Reference is made to FIG. 8. FIG. 8 depicts an "exploded" view of components of one actuator 417, four of which are installed in FCAS assembly 415.

As stated, actuator 417 is comprised of electric motor 601, which by means of gear 801 transmits power in a rotary motion around propulsion axis 603 (the first axis) to a beveloid gear type of transmission 617, wherein, according to the illustrated example, transmission 617 has three pairs of gears—803, 805, and 807, the latter of which is adapted to counter Tooth wreath type of gear wheel 809 at the end of which a connecting means is formed to connect with fin 433 and propel the fin into an angular motion around angular motion axis 495 (the second axis).

Needless to say that in an actuator implemented in a mechanism for steering and maneuvering an airborne body according to the invention, the electric motor (e.g. 601) could be any type of electrical servo motor (brushed or brushless).

A skilled person would understand that this is only an example, and a beveloid gear transmission according to the invention, for the purpose of transmitting power from an electric motor to an angular motion axis of a fin which is enabled to angular movement around a second axis in order to steer an airborne body by aerodynamic maneuvering or TVC, may have a different plurality of gears (cog-wheel) that may be formed differently.

Figure 9:
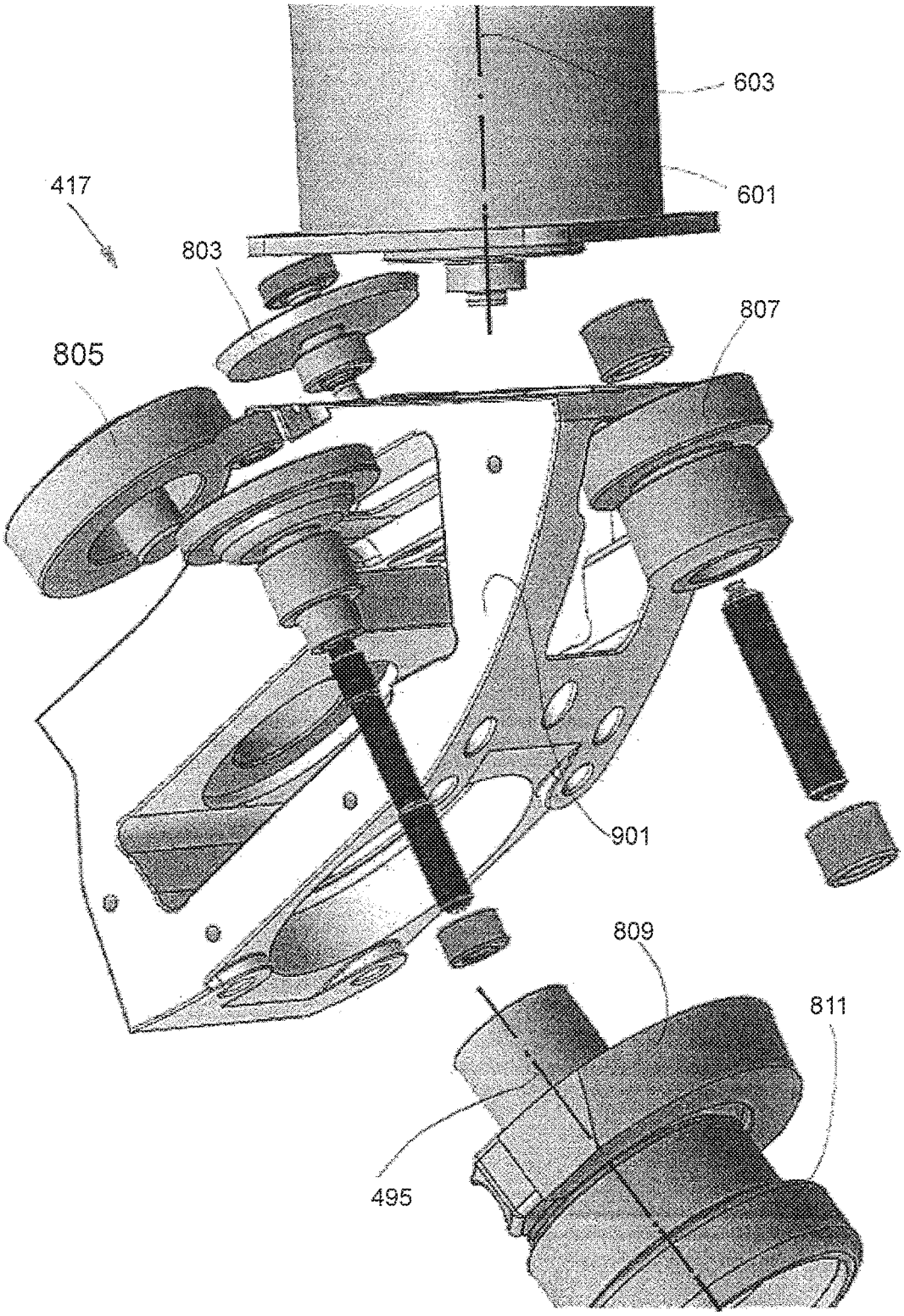
FIG. 9 depicts an "exploded" view of components of one actuator, four of which are mounted in the FCAS assembly according to the invention, that is illustrated in FIGS. 4-8, alongside a bracket component that is adapted for inserting the actuator and installing it around a rear section of the missile motor, while encompassing it and merging with the exterior design line of the missile.

Reference is made to FIG. 9. FIG. 9 depicts an "exploded" view of components of one actuator 417, four of which, as stated, are mounted in FCAS assembly 415, alongside a bracket component 901 that is adapted for inserting and mounting the actuator around a rear section of the missile motor, while encompassing it and merging with the exterior design line of the missile.

A skilled person would understand that FCAS assembly 415 also comprises common components of command, power supply, control (e.g. wiring, sensors), hardware (e.g. bearings), and a bracket which, as noted, is made (e.g. by aluminum machining) to serve as a base for positioning the four actuators on it and is included to be installed with them in the airborne body. These are means that are known in the field and are part of the common knowledge of the skilled persons in the field, and therefore for the sake of the reader's convenience, they have not been fully illustrated or described in detail.

However, just as an example, FIG. 9 illustrates components of actuator 417 (similar to the description hereinabove while referring to FIG. 9), next to which are axes elements and bearing components that are implemented for mounting gear transmission 617 and their insertion on bracket 901. According to the illustrated example, bracket 901 is formed as a volumetric arched portion whose inner part is adapted for installation while encompassing the variable geometry of the gas expansion nozzle of the missile's rocket motor, whereas its outer part is adapted for merging with the missile's exterior line of design (installed with screws to the missile's fuselage outer cover or skirt).

According to the illustrated example, four brackets (corresponding with the number of actuators) jointly form an apparatus (bracket) having a toroidal ring-like cross-section, which is adapted for installation around a rear section of the missile motor while encompasses it and merges with the missile's exterior line of design.

A skilled person would understand that detailed design and selection of the hardware (e.g. bearings, axes, brackets), implemented in the actuators of mechanism for steering and maneuvering an airborne body according to the invention, required mere ordinary engineering design as known in the field while taking into account the mechanical and thermal stress exist in such mechanisms.

Figure 2:
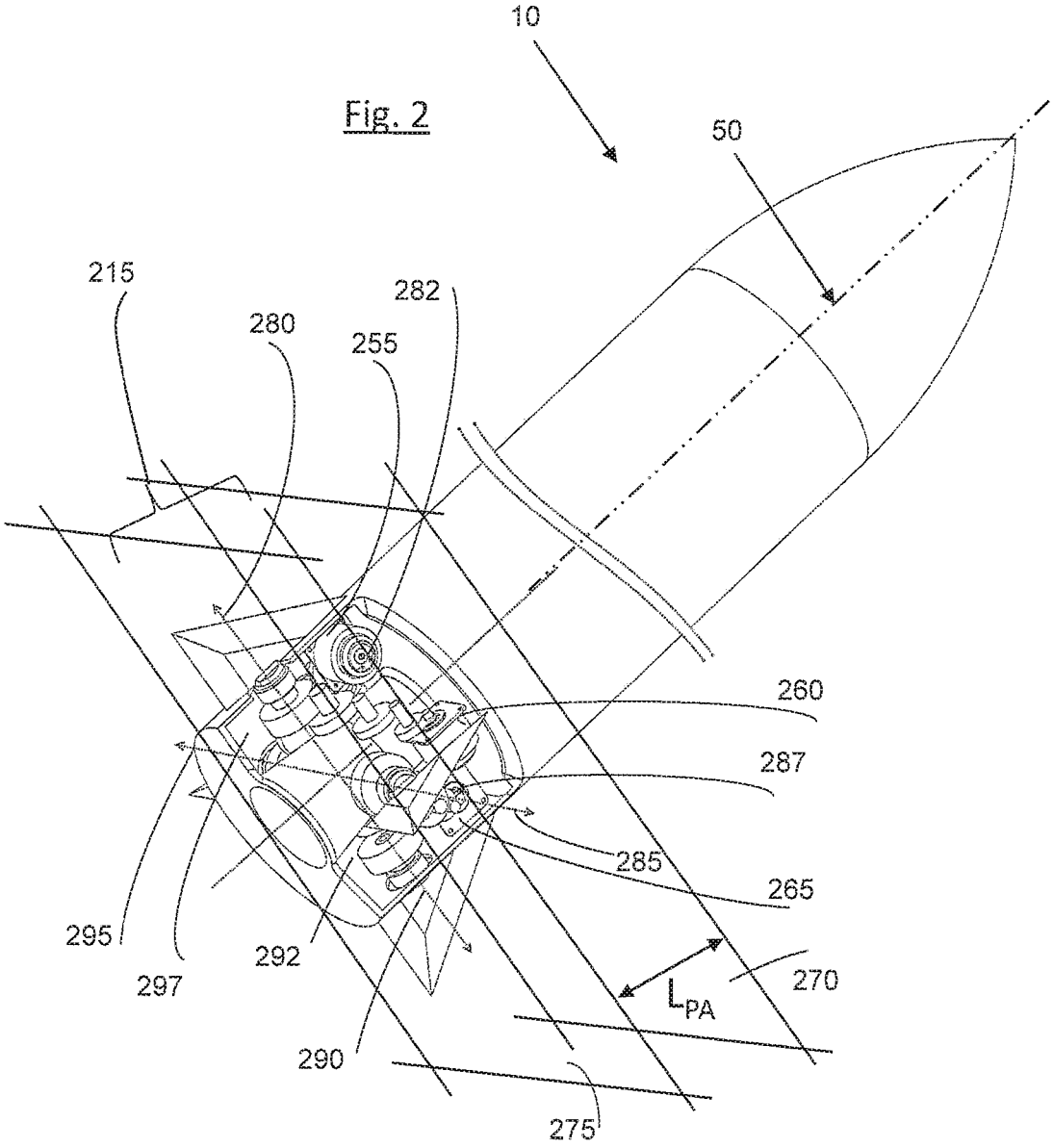
Figure 10:
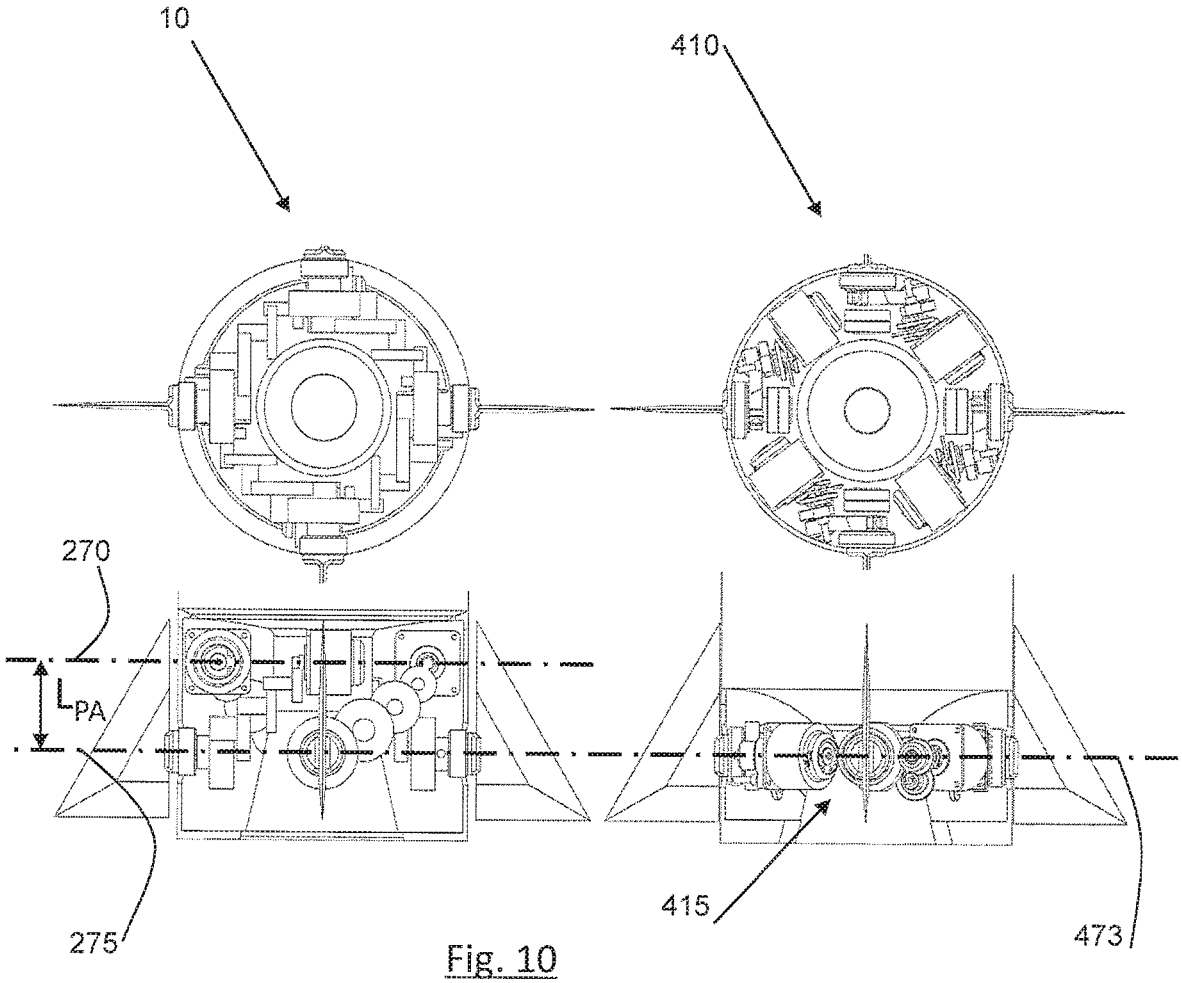
FIG. 10 depicts side by side, each in front view and in a side view (in a partial cross-section), the prior art solution to the packaging challenge described above in reference to FIG. 1, according to the prior art solution illustrated in FIGS. 2 and 3, compared with the solution to the same challenge as provided by the FCAS assembly according to the invention, which is illustrated in FIGS. 4-9.

Reference is made to FIG. 10. FIG. 10 depicts side by side, each in a front view and in a side view (in a partial cross-section), the prior art solution to the packaging challenge described above with reference to FIG. 1, according to the prior art solution illustrated in FIGS. 2 and 3, compared with the solution to the same challenge provided by FCAS assembly 415, which is illustrated in FIGS. 4-9.

In light of the illustration in FIG. 10, a skilled person would appreciate that in FCAS assembly 415, the circumferential array of the four actuators is packaged on one single plane 473, which is perpendicular to the central longitudinal axis of the missile, thereby achieving a considerable savings in volume needed for its packaging. This is compared to the prior art that called for displacing the array of motors relative to the plane of the angular motion axis of the fins, while creating planes spaced from each other at LPA.

Furthermore, a skilled person would also appreciate that FCAS assembly 415 does not have constraints that call for parallel positioning of each of the motor axes in relation to the angular motion axis of the fin that it propels, in a manner that also limits the ability for compact packaging, as required. Adopting the beveloid gear type transmissions for the FCAS assembly according to the invention allows for angularly tilting the motor axes, whereby—unlike the prior art solution—the transmissions do not also have to serve as an extension and bridging assembly between the motors. This is in contrast with the prior art, which because of the missile diameter constraint and the need for the motor axis to be parallel to the angular motion axis of the fin to which it is connected, the transmissions are pushed to another plane and at a distance from the angular motion axes of the fins.

Moreover, in light of the above description in reference to FIGS. 3 and 4, a skilled person would appreciate that in an FCAS assembly according to the illustrated example, the beveloid gear cog-wheels may be axially attached when mounted in a manner that would reduce unwanted backlash.

Axial attachment obviates the need, according to the prior art, to increase the diameter of the cog-wheels at the exit axis of the transmission for reducing backlash, which also translates to enlarging the dimensions of an assembly according to the prior art. In addition, a skilled person would appreciate that in an FCAS assembly according to the illustrated example, known mechanisms for reducing the backlash phenomena may easily implemented (e.g.—screw-nut-spring type of backlash reducing mechanism).

The Patent Applicant has proven the applicability of the invention in a design of an FCAS assembly, such as 415, illustrated in FIG. 10, in comparing it to the prior art solution. Given the geometric constraints of the same airborne body (missile 10 and missile 410 having the same size body diameter D), implementing the invention has enabled reducing the volume required for packaging of the FCAS assembly by 2-2.5 times compared to the prior art design (see there and in FIGS. 2 and 3), and reducing unwanted backlash by up to 25% compared to the prior art design.

As noted, the embodiment of the invention described above, with reference to the accompanying figures, relates to a missile-type airborne body having a rocket propulsion system and an FCAS assembly that is used to steer a circumferential array of four tail wings. However, a person skilled in the art would understand that the invention may also be applicable for steering other airborne bodies (e.g. jet-propelled cruise missiles, guided bombs, guided artillery shells, etc.), for steering a different number of fins (not necessarily four), and for steering other or additional types of fins (e.g. a canard type of fins positioned in the front part of an airborne body or an array of fins positioned in the middle of the airborne body). Moreover, a skilled person would understand that this is only an example, and that the invention can also be embodied as a jet vane steering mechanism in TVC systems. That is, the invention is applicable both to mechanical systems based on fins, which protrude from the airborne body and move in the desired direction and to the extent required to achieve the desired flight path of the airborne body by aerodynamic maneuvering (rudder type of fins such as the configuration described above with reference to the accompanying figures) as well as mechanical systems based on moveable fins) that are located at the nozzle of the rocket motor and are used to steer missiles by diverting the exhaust gases (jet vanes type of fins).

Furthermore, in light of the embodiment of the invention, as described above with reference to the accompanying figures, a skilled person would understand that the invention embodies a general method in the field of mechanisms, which are used to steer and maneuver airborne bodies, whether in an FCAS assembly of any airborne body (e.g. in a rocket-propelled missile, jet-powered cruise missile, guided bomb or a guided artillery shell) or in a TVC assembly in a missile. That is to say, a general method in the field of mechanical systems that are based on fins that move in the desired direction and to the desired extent in order to achieve the desired flight path of an airborne body. A method that comprise the steps of packaging the airborne body with an assembly comprised of transmissions of the beveloid gears type, as a means for transmitting power from the electric motors in the assembly to the angular motion axes of the fins of the airborne body, and steering the airborne body by transmitting power, as required, from the electric motors in the above assembly to the angular motion axes of the fins of the airborne body through the transmissions in order to change their position in an angular motion, thereby obtaining the desired flight path of the airborne body.

The Patent applicant provided the above description in referring to the accompanying figures for illustrative purposes only. The description above should not be limited to the illustrated figures. On the contrary, the description provided should be seen as also covering a wide range of alternatives, adjustments and equivalents, all without deviating from the embodiments defined in the following set of claims.

The invention claimed is:

1. A mechanism for steering and maneuvering an airborne body comprising:

a plurality of actuators arranged circumferentially about a longitudinal central axis of the airborne body, each actuator comprising: an electric motor having a first axis, and a gear transmission for transmitting power from the electric motor to an angular motion axis of a respective fin coupled to the actuator to steer the airborne body by aerodynamic maneuvering or Thrust Vector Control (TVC), wherein the gear transmission is a beveloid gear transmission, wherein the beveloid gear transmission transmits power from the electric motor to the fin, while the first axis of the motor is not parallel to the angular motion axis of the fin, but is positioned to create an angle between the two axes.

2. A Fin Control Actuation System (FCAS) assembly comprising the mechanism for steering and maneuvering an airborne body of claim 1, the airborne body having a rocket propulsion system along its central longitudinal axis.

3. The FCAS assembly of claim 2, wherein the plurality of actuators is a circumferential array of four actuators.

4. The FCAS assembly of claim 2, wherein the FCAS assembly comprises an apparatus having a toroidal ring-like cross-section configuration, wherein the plurality of actuators is installed in the apparatus, the apparatus is adapted for installation around a rear section of a missile motor of a rocket propulsion system such that the apparatus encompasses the rear section of the missile motor.

5. The FCAS assembly of claim 4 wherein the plurality of actuators is packaged in one plane perpendicular to the central axis of the airborne body.

6. An airborne body that comprises the mechanism for steering and maneuvering of claim 1.

7. A method of achieving the desired flight path of an airborne body having the mechanism of claim 1 by means of the respective fins of each actuator that move in the desired direction and to the extent required for achieving the desired flight path of the airborne body by aerodynamic maneuvering or Thrust Vector Control (TVC), the method comprising packaging the airborne body with an assembly comprised of the beveloid gear transmissions of each actuator as a means for transferring power from the electric motors in the assembly to the angular motion axes of the fins of the airborne body.

8. The method of claim 7, further comprising steering the airborne body by transferring powers, as required, from the electric motors of the assembly to the angular motion axes of the fins of the airborne body through the transmissions of beveloid gear type to change the position of the fins in an angular motion, thereby obtaining the desired flight path of the airborne body.

9. The mechanism of claim 1, wherein the plurality of actuators is packaged in one plane perpendicular to the central axis of the airborne body.

10. The mechanism of claim 9, wherein the plurality of actuators is a circumferential array of four actuators.

11. An airborne body comprising the mechanism of claim 10.

12. An airborne body comprising the mechanism of claim 9.

13. An airborne body comprising the mechanism of claim 1 wherein the airborne body is selected from: jet-propelled cruise missiles, guided bombs, guided artillery shells and a missile.

14. A Fin Control Actuation System (FCAS) assembly comprising the mechanism for steering and maneuvering an airborne body of claim 1, wherein the FCAS assembly comprises an apparatus having a toroidal ring-like cross-section and the plurality of actuators is installed in the apparatus.

15. The FCAS assembly of claim 14, wherein the apparatus is adapted for installation around a rear section of a missile motor of a rocket propulsion system such that the apparatus encompasses the rear section of the missile motor.

16. The FCAS assembly of claim 14, wherein the plurality of actuators is packaged in one plane perpendicular to the central axis of the airborne body.

17. The FCAS assembly of claim 14, wherein the plurality of actuators is a circumferential array of four actuators.

18. The FCAS assembly of claim 17, wherein the assembly is adapted for installation of four fins on the airborne body, each of which has an angular motion revolving around an axis by means of the circumferential array of four actuators.

19. The FCAS assembly of claim 18, wherein the four fins serve as tail wings of the airborne body for steering the airborne body by tail control of the four fins.

* * * * *